US005700087A

United States Patent [19]

Beckett et al.

[11] Patent Number: 5,700,087

[45] Date of Patent: Dec. 23, 1997

[54] DEVICE MAXIMIZING DISPERSION OF AGGREGATE IN LIQUID DILUENT

[76] Inventors: Arnold H. Beckett, 20 Braybrooke Gardens, Fox Hill, Upper Norwood, London, England, SE19 2UN; James E. Swon, 12 Twin Park Dr., Brookside, N.J. 07926; Henry Z. Hofer, 30 Bruce Dr., East Hanover, N.J. 07936

[21] Appl. No.: 540,022

[22] Filed: Oct. 6, 1995

[51] Int. Cl.[6] ..... B01F 7/16

[52] U.S. Cl. ..... 366/241; 366/279; 366/245

[58] Field of Search ..... 366/279, 302, 366/306, 314, 331, 262, 263, 264, 265, 266, 270, 325.1, 330.1, 348, 349, 244, 245, 247, 249, 250, 251, 241, 242

[56] References Cited

U.S. PATENT DOCUMENTS

| | | | |
|---|---|---|---|
| 3,129,066 | 4/1964 | Ambrogi et al. | 366/270 |
| 4,070,957 | 1/1978 | Korekawa et al. | 366/279 |
| 4,150,900 | 4/1979 | Smith et al. | 366/302 |
| 4,382,685 | 5/1983 | Pearson | 366/306 |
| 4,932,787 | 6/1990 | Fasano | 366/279 |

*Primary Examiner*—Tony G. Soohoo

*Attorney, Agent, or Firm*—William T. Hough, Esq.

[57] ABSTRACT

For specialized use to secure reliable standardized complete distribution or solution of aggregate mixed into a liquid diluent, a vessel having an interior hemispherical concave bottom having extending upwardly centrally from the concave bottom an arcuate conical member having upright concavely-shaped circumscribing sides. The vessel is taken in conjunction with a stably mounted mixing structure having a downwardly-extending shaft and mixing blades thereof. The shaft on a lower portion thereof supports balanced mixing blades extending radially outwardly from the mixing shaft. The mixing blades are positioned to be substantially spaced below a predetermined liquid level of liquid diluent containing a dissolvable or suspendable aggregate and to be substantially spaced above an upper end of the centrally upwardly arcuate conical member. The blades when positioned and when the mixing structure is set to revolvably the blade at a predetermined result-intensive rpm, results in homogeneously distributed aggregate in liquid contained diluent.

20 Claims, 1 Drawing Sheet

DEVICE MAXIMIZING DISPERSION OF AGGREGATE IN LIQUID DILUENT

ACKNOWLEDGED PRIOR ART

A prior art search having been conducted in United States Class 366, subclasses 306 and 314, while no relevaent patents were located, patents of interest include U.S. Pat. Nos. 1) 4,382,685 to Pearson and No. 2) 4,534,656 to Bruyne, as follow:

1) Pearson patent is directed to a method and apparatus directed to low reduced damage to growing living cell of a liquid culture medium by utilization of a flat-bottomed vessel, and the stirring of the liquid cell culture therein at as low stirring speed as possible by use of a sweeping downwardly-suspended rod-mounted bulbous (spherical) tip through an annular channel or trough contoured to follow flow lines set up in the medium by stirring motion of the bulbous tip, enabling maximizing of yield of cells by reduced cell damage occasioned by other types and apparatuses of stirring.

2) Bruyne patent directed to cell-growth culture medium inclusive of growing cells, utilizing a substantially flat floating magnetic stirrer mounted on and around an elongated downwardly-extending rod, directed to avoiding possible damage to or crushing of cultured growing cells in the liquid culture being stirred with a flat-bottomed vessel having lower arcuate portions/fillets separated by a flat bottom interior directed potentially to obviating stagnent zones to enhance culture's cell growth that otherwise would be deterred.

DESCRIPTION OF THE INVENTION

A) Description of the invention having meaning and context in light of existing prior background, relevant background is as follows, enabling understanding of the invention.

Prior to the present invention, consumers have suffered in product quality control as a result of inprecise measurement figures resulting from inaccurate concentrations of supposedly included aggregate—such as soluble solute and/or suspendable aggregate—such as colloidal or other small insoluble but suspendable aggregate. Government regulations require that minimum standards be maintained, policed by government departments, requiring as accurate measurements and reporting as made possible by available equipment. Heretofore, stirring of such desired soluble or suspended aggregates has been less that optimal because of, in pert at-least, incomplete and/or poor stirring devices and/or equipment combinations.

B) Knowledge and understanding of objects of the invention, make possible improved understanding of the purpose and relevance of the following inventive structure/device in light of prior background and present objects, as follow.

One object of the present invention is to obtain combination device for obtaining repeatable reliable dissolution of given amounts of solute or suspendable aggregate in a liquid diluent.

Another object is to make available a combination of laboratory apparatuses by which reliable repeatable concentrations of solute aggregate and/or suspendable aggregate may obtained through the use thereof by commercial manufacturers of products subject to government quality controls.

Another object is to obtain a mixing apparatus which by the use thereof makes low cost of equipment and use thereof commercially available for effecting the achieving of repeatable accurate and maximized solutions and/or suspensions of dissolvable and/or suspendable aggregate of commercial products, particularly those subject to government quality controls and reporting thereon.

Another object is to achieve one or more of foregoing objects, at a minimum of required financial investment in and for achieving simplicity in the proper and successful use of simple equipment to achieve maximized levels of soluble and/or suspendable aggregate in a liquid diluent.

Other objects become apparent from the preceding and following disclosure.

C) BRIEF SUMMARY OF THE INVENTION

1. Broadly as a first broad embodiment, the invention may be described as a standardized uniform-distribution mixing device that includes several elements in a critical combination.

A first element is an elongated shaft of an interior of a vessel that is substantially centrally-spaced to be in a center of the vessel-defined space. The elongated shaft is a revolvable elongated linear shaft having an elongated longitudinally-extending axis and having substantially distally-mounted blade portions. The blade portions are each radially-outwardly extending substantially equally-balanced blade and are mounted around and extending substantially radially-outwardly from one-another. The radially-outwardly extending equally-balanced blade portions are positioned in a downwardly state immersible within a liquid diluent; the radially outwardly equally-balanced blade is critical in order to get consistent and wobble-free stirring agitation and resulting uniform dissolution of aggregate within the liquid diluent. The liquid diluent is suspendable or dissolvable of aggregate containable within an equally critical predetermined liquid-containable vessel containable of a liquid diluent and an aggregate therein.

A second element is a aforestated critically-shaped predetermined liquid-containable vessel in critical combination with the preceding aforesated first element. Unlike prior mixing vessels devoid of a totally arcuate bottom, and more particularly devoid of a "combination" of an inner radially outwardly exagerated circumscribing arcuate portion at the bottom of the vessel, being totally devoid of an entire totally arcuate bottom inner hemisphere coupled with—i.e. in combination with—an arcuate bottom as a continuation with the bottom inner hemispherical interior bottom continuing as any upright central element and devoid of any appreciation of the importance of such combination as an essential to the obtaining of consistent uniform homogeneous and miximum distribution of an aggregate within a liquid diluent, this second element of the present invention has a substantially totally hemispherical interior concave bottom critically in critical combination with a substantially centered upwardly-extending inverted substantially aarcuate member in the nature of a conically-shaped vessel bottom member having arcuately base substantially continuous with upwardly extending arcuate walls. Thereby there is formed an interior liquid containable vessel-space of substantially circular cross-section of which substantially all containing inner surfaces of the circumscribing interior wall and of the continuing bottom and of the continuing upwardly-extending conical member are each and all characterized by inner arcuate wall surfaces. The substantially hemispherical interior bottom and the substantially centered upwardly-extending inverted substantially conically-shaped vessel bottom member jointly in the aforestated critical combination are sufficiently arcuate as to substantially avert substantially any non-circulation dead-volume of substantially any accumulated portion of either or both liquid diluent and dissolvable or suspendable aggregate within liquid diluent a) when contained by and within the aforestated liquid-containable vessel and b) concurrently when a shaft revolvable-driving structure(s) (and mechanism(s) thereof) for revolvably driving the revolvable elongated linear shaft at a predetermined rate is stably mounted and positioned in the interior liquid containable vessel space.

A third element is the aforestated revolvable shaft that is critically mounted for the aforestated blades mounted thereon to be critically located (positioned) and centered substantially within vessel interior space as the downwardly radially-outwardly extending equally-balanced revolvable shaft having a longitudinal axis at a critical level (degree of insertion) within the liquid diluent. The third element-revolvable shaft is stably mounted with the aforestated blades thereof positioned within and substantially centrally of and sufficiently downwardly extending into the interior liquid containable vessel-space sufficiently that the radially-outwardly extending equally-balanced blade portions are substantially immersed in sufficiently close proximity to and substantially spaced-above the substantially centered upwardly-extending inverted substantially conically-shaped vessel bottom member when liquid diluent with dissolvable or suspendable aggregate is contained within the predetermined liquid-containable vessel. Thereby aggregate dissolvable or suspendable in a liquid diluent is substantially uniformly circulatable around the substantially centered upwardly-extending inverted substantially conically-shaped vessel bottom member and within other liquid diluent suspendable or dissolvable of aggregate containable within the predetermined liquid-containable vessel during mixing therein aggregate dissolvable or suspendable therein.

And there is also required a critical fourth element, namely the aforestated shaft that is revolvable-driving structure(s) (and mechanism(s) thereof revolvably drivable of the revolvable elongated linear shaft at a critical predetermined rate within a critical predetermined range of revolutions per minute of revolvable mixing. This assumes its function when the substantially distally-mounted radially-outwardly extending equally-balanced blade portions are mounted to be substantially mixably immersed within liquid diluent containing therein aggregate dissolvable or suspendable therein, in combination with the substantially distally-mounted radially-outwardly extending substantially equally-balanced blade portions being substantially positioned spaced-above the substantially centered upwardly-extending inverted substantially conically-shaped vessel bottom member and concurrently being revolvable by the shaft revolvable-driving structure(s) (and mechanism(s) thereof) at the aforestated predetermined rate sufficiently to achieve and maintain a substantially uniform and substantially homogeneous distribution of suspendable aggregate within and throughout a liquid diluent contained in and substantially throughout the interior liquid containable vessel-space.

In a first preferred embodiment, as improvement on the foregoing broad invention above-described, the aforestated predetermined liquid-containable vessel includes each of:

a) an upright upper outer wall surface; and b) at-least one substantially radially-extending support member of a size and shape suspendable of the entire the liquid-containable vessel. The support member is alternatedly self-supporting by base support structure thereof or associated separate base support structure supportingly secured to the upright upper outer wall surface, being supportable by any suitable support base support structure.

In a second preferred embodiment, as a further improvement on the foregoing first preferred embodiment, the at-least one substantially radially-extending support member is in the form of a radially-outwardly upper-vessel circumscribing flange.

In a third preferred embodiment, as a further improvement on the foregoing second preferred embodiment, the substantially centered upwardly-extending inverted substantially conically-shaped vessel bottom member has concavely-shaped arcuate upright sides.

In a fourth preferred embodiment, as a further improvement on the foregoing third preferred embodiment, the concavely arcuate upright sides have a radious ranging from about 0.8 inches up to about 4 inches.

In a fifth preferred embodiment, as a further improvement on the third preferred embodiment, the concavely shaped arcuate upright sides have a radius ranging from about 1.5 inches up to about 3 inches.

In a sixth preferred embodiment, as a further improvement on the fifth preferred embodiment, the substantially centered upwardly-extending inverted substantially conically-shaped vessel bottom member has a substantially circular circumscribing bottom portion having a radius ranging from about 0.6 inches up to about 1.2 inches.

In a seventh preferred embodiment, as a further improvement on the fourth preferred embodiment, the substantially centered upwardly-extending inverted substantially conically-shaped vessel bottom member has a substantially circular circumscribing bottom portion having a radius ranging from about 0.3 inches up to about 1.7 inches.

In a eighth preferred embodiment, as a further improvement on the seventh preferred embodiment, the predetermined liquid-containable vessel has interior upwardly-spaced substantially vertically-extending substantially cylindrically-shaped radially-inwardly facing inner walls and upper liquid-containable edges to the interior substantially vertically-extending walls with the interior upwardly-extending substantially cylindrically-shaped radially-inwardly facing inner walls extending to the upper liquid-containable edges a height-distance ranging from about 3 inches up to about 12 inches.

In a ninth preferred embodiment, as a further improvenent on the sixth preferred embodiment, the predetermined liquid-containable vessel has interior upwardly-spaced substantially vertically-extending substantially cylindrically-shaped radially-inwardly facing inner walls and upper liquid-containable edges to the interior substantially vertically-extending walls with the interior upwardly-extending substantially cylindrically-shaped radially-inwardly facing inner walls extending to the upper liquid-containable edges a height-distance ranging from about 3.8 inches up to about 6.5 inches.

In a tenth preferred embodiment, as a further improvement on the ninth preferred embodiment, the substantially hemispherical interior concave bottom has a lower-most bottom portion, and the substantially centered upwardly-extending inverted substantially conically-shaped vessel bottom member has a height above said lower-most bottom portion ranging from about 0.2 inch to about 1 inch.

In a eleventh preferred embodiment, as a further improvement on the eighth preferred embodiment, the substantially hemispherical interior concave bottom has a lower-most bottom portion, and in which said substantially centered upwardly-extending inverted substantially conically-shaped vessel bottom member has a height above said lower-most bottom portion ranging from about 0.5 inch to about 0.8 inch.

In a twelfth preferred embodiment, as a further improvement on the eleventh preferred embodiment, the radially-outwardly extending equally-balanced blade portions each have a radius of from about 0.2 inch up to a length ending at a point at-least spaced-from said interior upwardly-extending substantially cylindrically-shaped radially-inwardly facing inner walls and from the substantially hemispherical interior concave bottom.

In a thirteenth preferred embodiment, as a further improvenent on the tenth preferred embodiment, the radially-outwardly extending equally-balanced blade portions each have a radius of from about 0.5 inch up to about 1 inch and spaced from said substantially hemispherical interior concave bottom.

In a fourteenth preferred embodiment, as a further improvenent on the thirteenth preferred embodiment, the radially-outwardly extending equally-balanced blade portions each have a width of from about 1 inch to about 4 inches.

In a fifteenth preferred embodiment, as a further improvement on the twelfth preferred embodiment, the radially-outwardly extending equally-balanced blade portions each have a width of from about 2.5 inches to about 3.5 inches.

In a sixteenth preferred embodiment, as a further improvenent on the fourteenth preferred embodiment, there is additionally included a plurality of the substantially distally-mounted radially-outwardly extending substantially equally-balanced blade portions mounted around and extending substantially radially-outwardly from one-another mounted above one-another on the vessel interior substantially space-centered downwardly extending revolvable elongated linear shaft.

In a seventeenth preferred embodiment, as a further improvement on the seventeenth preferred embodiment, the shaft revolvable-driving means is revolvably drivable of said revolvable elongated linear shaft at said predetermined rate, and in which said predetermined rate ranges between about eight rpm and about 250 rpm.

In an eighteenth preferred embodiment, as a further improvement on the aforestated broad invention, the shaft revolvable-driving means is revolvably drivable of the revolvable elongated linear shaft at the predetermined rate, and the predetermined rate ranges between about eight rpm and about 250 rpm.

In the practice of the present invention, included is a method of homogeneously mixing at-least one of solute and insoluble aggregate within a liquid vehicle. That method includes 1) utilizing the standardized uniform-distribution mixing device of the aforestated broad invention, and 2) revolving the shaft revolvable-driving means at the predetermined rate within a range of from about eight (8) rpm up to about 250 rpm for a period of time sufficient to achieve substantially homogeneous distribution of matter being mixed within the liquid vehicle.

DETAILED DESCRIPTION

Figure 1:
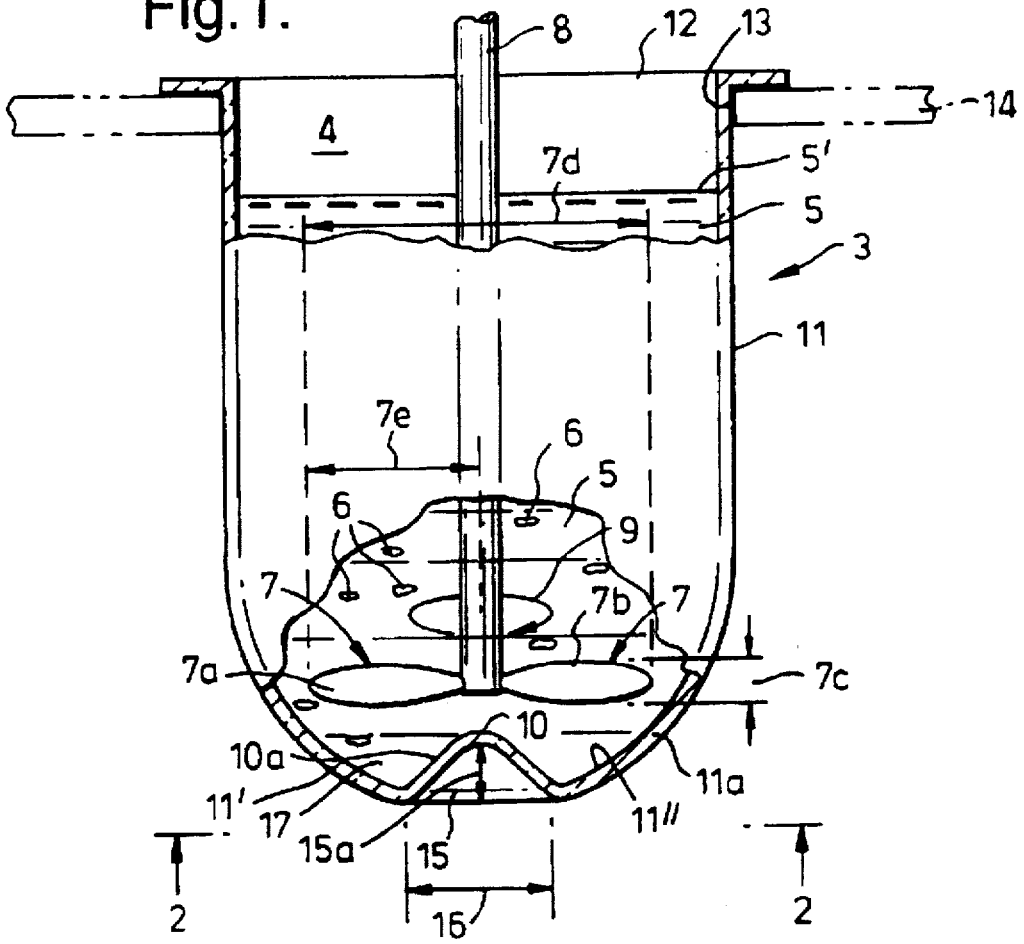
FIG. 1 diagrammatically and symbolically illustrates a typical and preferred embodiment of the invention, including the liquid-containing vessel having dissolvable solute therein shown in side view with partial cut-aways and the downwardly-extending revolvable shaft and blade mounted thereon spaced-above the upwardly extending central inverted-conically and arcuately-shaped vessel bottom member (that is an integral part of the bottom) having the horizontally-positioned radially-outwardly extending blade positioned above and in close proximity to the upwardly-extending central inverted-conically and arcuately-shaped bottom member, with the blade being fixedly-mounted on a downwardly extending revolving shaft revolving the blade as shown below liquid level.
Figure 2:
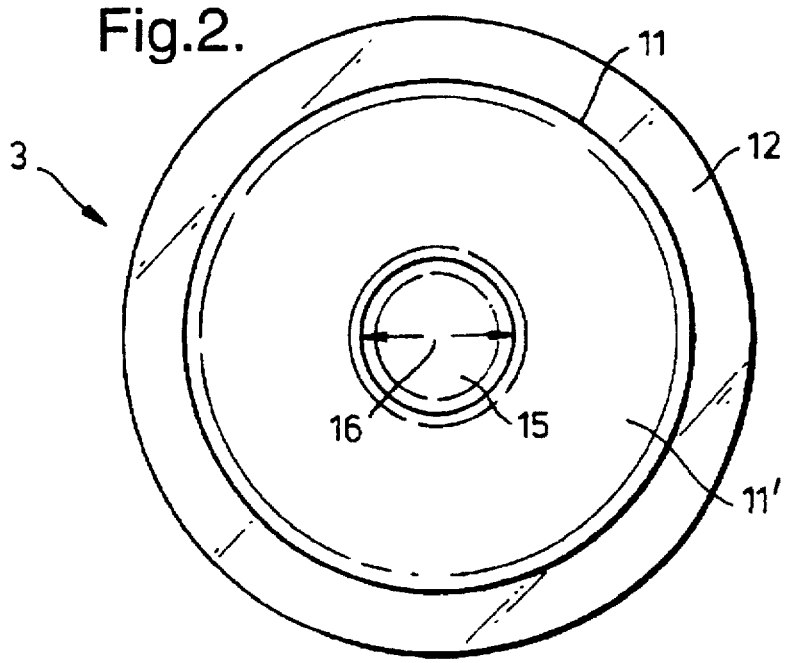
FIG. 2 diagrammatically and symbolically illustrates a view as taken along lines 2—2 of FIG. 1.

FIGS. 1 and 2 illustrate differing views of the same embodiment, including the overall vessel 3 (conventionally referred to as a round-bottomed beaker) having interior space 4 containing liquid with upper liquid-level surface 5' having suspended therein a typically dissolvable aggregate (or solute) distributed therein by virtue of the blade 7 inclusive of oppositely-extending blades **7*a* and 7*b* revolved with the shaft 8 in direction 9 in the close proximity illustrated relative to the upper-most portion 10 of the upwardly-extending central inverted-conically and arcuately-shaped bottom member 10*a*. The vessel 3 has typically an upright circumscribing outer-wall 11 of transparent glass or plastic 11*a*. The upright wall 11*a* has an upper radially outwardly extending flange 12. The blade 7 has an angular twist extending within a range 7*c* and has a length (from tip to tip) if 7*d* made-up of two end-to-end radius lengths 7*e*. The flange 12 is typically supportable within a through-space hole 13 of a support structure 14 (shown in-part, in phantom. The vessel 3 has its wall 11 continuous with the rounded exterior bottom 11' and the inner arcuate concavely shaped bottom 11" forming the outer bottom cavity space of a depth 15 and a bottom outer-diameter 16**.

FIG. 2 in its bottom view along 2—2 of FIG. 1, illustrates some of the corresponding above-described features of FIG. 1.

With the previously-described spacing of the blade 7 above and in the close proximity to the upper-most portion 10, within a lower portion of the liquid 5 in which the solute (aggregate) 6 is being stirred and/or dissolved, as result of this positioning, take with the upwardly-extending arcuately-shaped bottom member **10*a*, and together with sufficient rpm of the revolving in revolving direction 7 (or alternately opposite and/or intermittent change of directions) at a required rate sufficient to forcefully circulate the liquid (or solvent) 5 around the upwardly-extending arcuately-shaped bottom member 10*a*, there is avoided a collection of undissolved and/or unsuspended amount of solute (aggregate) in the vicinity of space/position 17—which collection thereof heretofore has resulted prior to the present invention. As aforestated, the revolutions rate of the shaft 8 and the blade 7 mounted thereon taken with the close-proximity position of the blade to the upper-most portion 10, within a lower portion of the liquid 5**, all critically contribute to the inventive process aforenoted, resulting in the avoiding of heretofore remaining of unmixed and/or undissolved solute and/or aggregate remaining consistently in the bottom of the inner vessel space of a container mixing vessel.

The term "diluent" herein includes static medium and/or a diluting and/or thinning agent. Moreover, the term diluent include any one or more of fluid, liquid or solid suspension and/or mixing media, each or one or more thereof being subject to the benefits of this aforedescribed invention.

It is within the scope of the present invention to make variations, modifications and improvements on the present invention, to the extent of skill of an ordinary artisan in this particular art.

We claim:

1. A standardized uniform-distribution mixing device for mixing a liquid diluent suspension or a dissolution of aggregate comprising in combination:

1) a vessel-mounted, substantially centered, vertical, revolvable, elongated linear shaft having distally-mounted, radially-outwardly extending, substantially equally-balanced blade portions, said blade portions mounted around and extending substantially radially-outwardly from one another and being positioned in a downwardly positioned state when immersed within a liquid diluent contained within a liquid-containable vessel;

2) a liquid-containable vessel having a substantially hemispherical interior concave bottom, said hemispherical interior concave bottom having a substantially centered, upwardly-extending, inverted substantially conically-shaped vessel bottom member and upwardly extending walls forming an interior liquid containable vessel-space of substantially circular cross-section, said substantially hemispherical interior concave bottom and said substantially centered, upwardly-extending, inverted substantially conically-shaped vessel bottom member jointly in combination being sufficiently arcuate as to substantially avert any non-circulation dead-volume of any accumulated portion of either or both liquid diluent and dissolved or suspended aggregate contained by said liquid-containable vessel when said elongated linear shaft is driven at a predetermined rate and positioned in said interior liquid containable vessel space;

3) said elongated linear shaft having a longitudinal axis and being stably mounted with the blade portions positioned within and substantially centrally of and sufficiently downwardly extending into said interior liquid containable vessel-space such that said blade portions are substantially immersed in sufficiently close proximity to and substantially space-above said substantially centered, upwardly-extending, inverted, substantially conically-shaped vessel bottom member when liquid diluent with dissolvable or suspendable aggregate is contained within said predetermined liquid-containable vessel and whereby dissolved or suspended aggregate in said liquid diluent is substantially uniformly circulatable around said substantially centered, upwardly-extending, inverted, substantially conically-shaped vessel bottom member; and 4) a shaft driving means for revolvably driving said elongated linear shaft at said predetermined rate of revolvable mixing when said blade portions are mounted to be substantially mixably immersed within said liquid diluent containing therein aggregate dissolvable or suspendable therein, and said blade portions being substantially positioned spaced-above said substantially centered, upwardly-extending, inverted, substantially conically shaped vessel bottom member and whereby said shaft is revolved by said shaft driving means at said predetermined rate sufficiently to achieve and maintain a substantially uniform and substantially homogenous distribution of suspendable aggregate within and throughout said liquid diluent contained in and substantially throughout said interior liquid containable vessel-space.

2. The standardized uniform-distribution mixing device of claim 1, in which said liquid-containable vessel includes 1) an upright upper outer wall surface; and 2) at least one substantially radially-extending support member of a size and shape supportingly secured to the substantially upright outer wall surface, suspendable of the entire said liquid-containable vessel when supported by base support structure.

3. The standardized uniform-distribution mixing device of claim 2, in which said at least one substantially radially-extending support member is in the form of a radially-outwardly upper-vessel circumscribing flange.

4. The standardized uniform-distribution mixing device of claim 3, in which the substantially centered, upwardly-extending, inverted, substantially conically-shaped vessel bottom member has concavely shaped arcuate upright sides.

5. The standardized uniform-distribution mixing device of claim 4, in which the concavely shaped arcuate upright sides have a radius ranging from about 0.8 inches up to about 4 inches.

6. The standardized uniform-distribution mixing device of claim 5, in which said substantially centered, upwardly-extending, inverted, substantially conically-shaped vessel bottom member has a substantially circular circumscribing bottom portion having a radius ranging from about 0.3 inches up to about 1.7 inches.

7. The standardized uniform-distribution mixing device of claim 6, in which said liquid-containable vessel has interior, upwardly-spaced, substantially vertically-extending, substantially cylindrically-shaped, radially-inwardly facing inner walls and upper liquid-containable edges, said inner walls extending to said upper liquid-containable edges at a height-distance ranging from about 3 inches up to about 12 inches.

8. The standardized uniform-distribution mixing device of claim 7, in which said substantially hemispherical interior concave bottom has a lower-most bottom portion, and in which said substantially centered, upwardly-extending, inverted, substantially conically-shaped vessel bottom member has a height above said lower-most bottom portion ranging from about 0.5 inch to about 0.8 inch.

9. The standardized uniform-distribution mixing device of claim 8, in which said blade portions each have a radius of from about 0.2 inch up to a length ending at a point at least spaced from said interior upwardly-extending, substantially cylindrically-shaped, radially-inwardly facing inner walls, and from said substantially hemispherical interior concave bottom.

10. The standardized uniform-distribution mixing device of claim 9, in which said blade portions each have a width of from about 2.5 inches to about 3.5 inches.

11. The standardized uniform-distribution mixing device of claim 4, in which the concavely shaped arcuate upright sides have a radius ranging from about 1.5 inches up to about 3 inches.

12. The standardized uniform-distribution mixing device of claim 11, in which said substantially centered, upwardly-extending, inverted, substantially conically-shaped vessel bottom member has a substantially circular circumscribing bottom portion having a radius ranging from about 0.6 inches up to about 1.2 inches.

13. The standardized uniform-distribution mixing device of claim 12, in which said liquid-containable vessel has interior upwardly-spaced, substantially vertically-extending, substantially cylindrically-shaped, radially-inwardly facing inner walls, and upper liquid-containable edges, said inner walls extending to said upper liquid-containable edges at a height-distance ranging from about 3.8 inches up to about 6.5 inches.

14. The standardized uniform-distribution mixing device of claim 13, in which said substantially hemispherical interior concave bottom has a lower-most bottom portion, and in which said substantially centered, upwardly-extending, inverted, substantially conically-shaped vessel bottom member has a height above said lower-most bottom portion ranging from about 0.2 inch to about 1 inch.

15. The standardized uniform-distribution mixing device of claim 14, in which said blade portions each have a radius of from about 0.5 inch up to about 1 inch and spaced from said substantially hemispherical interior concave bottom.

16. The standardized uniform-distribution mixing device of claim 15, in which said blade portions each have a width of from about 1 inch to about 4 inches.

17. The standardized uniform-distribution mixing device of claim 16, including a plurality of said substantially distally-mounted, radially-outwardly extending, substantially equally-balanced, blade portions mounted around and extending substantially radially-outwardly from one another and further being mounted above one another on said elongated linear shaft.

18. The standardized uniform-distribution mixing device of claim 16, in which said shaft driving means is revolvably drivable of said revolvable elongated linear shaft at said predetermined rate, and in which said predetermined rate ranges between about 8 pm and about 250 rpm.

19. The standardized uniform-distribution mixing device of claim 1, in which said shaft driving means is revolvably drivable of said revolvable elongated linear shaft at said predetermined rate, and in which said predetermined rate ranges between about 8 rpm and about 250 rpm.

20. A method of homogeneously mixing at least one of solute and insoluble aggregate within a liquid vehicle, comprising utilizing the standardized uniform-distribution mixing device of claim 1, and including revolving said shaft driving means at said predetermined rate within a range of from about 8 rpm and 250 rpm for a period of time sufficient to achieve substantially homogenous distribution of matter being mixed within said liquid vehicle.

* * * * *